US005702312A

United States Patent [19]

Horiuchi et al.

[11] Patent Number: 5,702,312

[45] Date of Patent: Dec. 30, 1997

[54] SOLID GOLF BALL

[75] Inventors: Kuniyasu Horiuchi, Kobe; Seiichiro Endo, Shirakawa; Keiji Moriyama, Shirakawa; Masatoshi Yokota, Shirakawa, all of Japan

[73] Assignee: Sumitomo Rubber Industries, Ltd., Hyogo-ken, Japan

[21] Appl. No.: 713,656

[22] Filed: Sep. 13, 1996

[30] Foreign Application Priority Data

Sep. 14, 1995 [JP] Japan ..... 7-236654

[51] Int. Cl.[6] ..... A63B 37/06; A63B 37/12

[52] U.S. Cl. ..... 473/377; 473/384; 473/351

[58] Field of Search ..... 473/384, 351.1, 473/377, 383

[56] References Cited

U.S. PATENT DOCUMENTS

| | | | |
|---|---|---|---|
| 4,968,038 | 11/1990 | Yamada | 473/384 X |
| 5,556,098 | 9/1996 | Higuchi et al. | 473/351.1 |
| 5,588,924 | 12/1996 | Sullivan et al. | 473/384 X |

*Primary Examiner*—George J. Marlo

*Attorney, Agent, or Firm*—Birch, Stewart, Kolasch & Birch, LLP

[57] ABSTRACT

A solid golf ball having good controllability and long flight distance and having a solid core, a cover covering the core and dimples formed on the surface of the cover, wherein the cover has a Shore D hardness of 52 to 64 and the dimples satisfy the following equation:

(Dimple area proportion (%))×(Total dimple volume ($mm^3$))÷100= 220 to 270.

4 Claims, 1 Drawing Sheet

SOLID GOLF BALL

FIELD OF THE INVENTION

The present invention relates to a solid golf ball having good controllability and long flight distance, which is comprised of a core, a cover covering the core and dimples formed on the surface of the cover wherein the product of the dimple area proportion and the total dimple volume is suitably adjusted.

BACKGROUND OF THE INVENTION

Hitherto, there have been mainly produced two types of golf balls. The one is a solid golf ball, such as a two piece golf ball, which comprises a core formed from vulcanized rubber material and a thermoplastic cover (e.g. ionomer cover) formed on the core. The other is a thread wound golf ball which comprises a liquid or solid center, a thread rubber winding layer formed on the center and a balata or ionomer cover formed thereon. The solid golf ball has a longer flight distance and a good flight performance in comparison with the thread wound golf ball, because it has higher ball speed at the time of impact and excellent durability. On the other hand, the solid golf ball has poor shot feel and exhibits poor controllability when playing an approach shot. The poor controllability comes from high ball speed and a small contact area between the golf ball and a golf club at the time of hitting, which reduces the spin amount and results in difficult controllability.

In order to improve the controllability and shot feel of a solid golf ball, it has been proposed that the cover of the solid golf ball be made soft. However, a soft cover simultaneously reduces impact resilience and lowers the flight distance when hit by a driver.

SUMMARY OF THE INVENTION

The present invention provides a solid golf ball which has a soft cover and dimples, wherein the dimple area proportion and the total dimple volume are adjusted to a suitable range, thus improving controllability and shot feel and keeping the flight distance equal or more to the conventional hard cover solid golf ball. The solid golf ball comprises a solid core, a cover covering the core and dimples formed on the surface of the cover, wherein the cover has a Shore D hardness of 52 to 64 and the dimples satisfy the following equation:

$$(\text{Dimple area proportion } (\%))\times(\text{Total dimple volume } (mm^3))+100=220 \text{ to } 270.$$

BRIEF EXPLANATION OF DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE INVENTION

Figure 1:
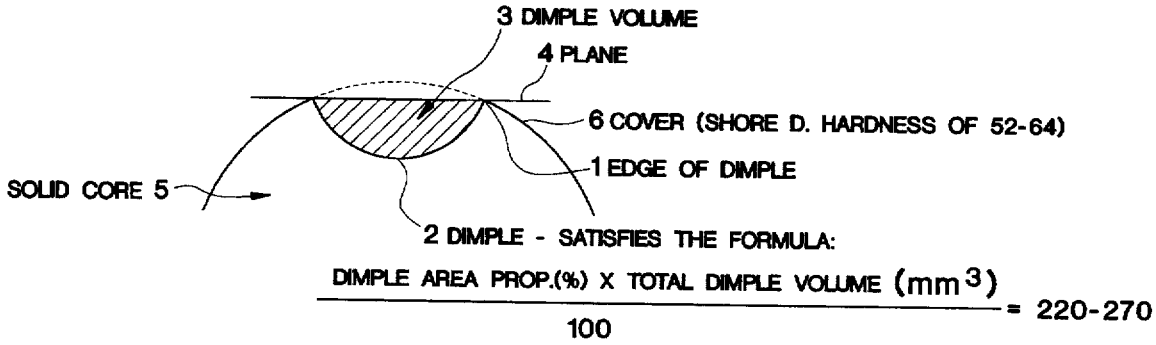
FIG. 1 is a schematic cross section illustrating one dimple of the solid golf ball of the present invention.

The solid golf ball of the present invention can be either a two piece solid golf ball or a multi-piece solid golf ball in which the core or cover is plural layered. The core and cover can be made from any materials which have been used for golf balls, as long as the golf ball satisfies the features as claimed. Typical examples of the core and cover are hereinafter explained.

The core employed in the solid golf ball of the present invention can be obtained by vulcanizing a rubber composition in a mold. The rubber composition used for the core generally contains a base rubber, a crosslinking agent, a co-crosslinking agent, an inert filler and the like.

The base rubber can be natural rubber or synthetic rubber which has been used for solid golf balls, for example polybutadiene, polyisoprene rubber, styrene-butadiene rubber and EPDM. Preferred is polybutadiene rubber having cis-1,4 structure of at least 40%. The base rubber can be a mixture of the rubbers mentioned above.

The crosslinking agent which is used for initiating crosslinking reaction can be peroxides, such as dicumyl peroxide and di-t-butyl peroxide. Preferred is dicumyl peroxide. An amount of the peroxide is not limited but can be 0.3 to 5.0 parts by weight, preferably 0.5 to 3.0 parts by weight, based on 100 parts by weight of the base rubber.

The co-crosslinking agent is used for inserting crosslinked structure into rubber molecules and can be any one which has been used for solid golf balls. Typical examples of the co-crosslinking agents are metal salts of unsaturated fatty acid, such as a single or divalent metal salt of α,β-unsaturated carboxylic acid having 3 to 8 carbon atoms. The metal includes sodium, potassium, magnesium, zinc and the like, and the α,β-unsaturated carboxylic acid includes acrylic acid and methacrylic acid. Preferred co-crosslinking agent is zinc acrylate because it imparts high rebound characteristics to the resulting golf ball. The co-crosslinking agent can be present in the rubber composition in an amount of 10 to 50 parts by weight, preferably 20 to 40 parts by weight based 100 parts by weight of the base rubber. Amounts of more than 50 parts by weight make the core too hard and those of less than 10 parts by weight make too soft and does not give enough deformation amount of the core.

The inert filler can be one used for golf balls and includes zinc oxide, barium sulfate, silica, calcium carbonate or zinc carbonate. Generally used is zinc oxide. An amount of the filler is not limited and can vary depending on specific gravity of core and weight regulation of golf ball, but may be within the range of 10 to 60 parts by weight based on 100 parts by weight of the base rubber.

The rubber composition can contain other components which have been used for cores of golf balls, such as antioxidant.

The above mentioned components are mixed to form a rubber composition which is then vulcanized at an elevated temperature under pressure in a mold to form a solid core. The vulcanization may be conducted at 120° to 180° C. for 10 to 60 minutes. The solid core of the present invention preferably has a diameter of 37 to 40 mm.

When the core is made two layers, an inner core is generally made from the above mentioned rubber composition and the outer core can be made from either the above mentioned rubber composition or another thermoplastic resin. The inner core preferably has a diameter of 25.0 to 38.0 mm, more preferably 27.0 to 36.0 mm and the outer layer has a thickness of 0.5 to 6.5 mm, preferably 1.0 to 6.0 mm, then its total being a diameter of 37 to 40 mm. The core can be made of more than two layers.

The solid core of the present invention preferably has a deformation amount of 2.50 to 3.50 mm, which is determined by applying from an initial load of 10 Kg to a final load of 130 Kg. If it is less than 2.50 mm, the core is too hard and shot feel and controllability would deteriorate. If it is more than 3.50 mm, the core is too soft and the rebound characteristics are reduced, resulting in poor flight distance.

The solid core obtained above is covered with a cover. The cover can be made from any material which has been used for the covers of golf balls, and typical examples of them are ionomer, polyamide, polyester, and a mixture thereof. Preferred is ionomer resin. Examples of the ionomer resin which is commercially available from Mitsui Du Pont Polychemical Co., Ltd. are ionomer resins such as Hi-milan 1605 (Na), Hi-milan 1707 (Na), Hi-milan AM7318 (Na), Hi-milan 1705 (Zn), Hi-milan 1706 (Zn), Hi-milan 1652 (Zn), Hi-milan AM7315 (Zn), Hi-milan AM7317 (Zn), Hi-milan AM7311 (Mg), Hi-milan MK7320 (K); and terpolymer copolymer ionomer resins such as Hi-milan 1856 (Na), Hi-milan 1855 (Zn), Hi-milan AM7316 (Zn), etc. Examples of the ionomer resin which is commercially available from Du Pont Co., U.S.A. include ionomer resins such as Surlyn 8920 (Na), Surlyn 8940 (Na), Surlyn AD8512 (Na), Surlyn 9910 (Zn), Surlyn AD8511 (Zn), Surlyn 7930 (Li), Surlyn 7940 (Li); and terpolymer copolymer ionomer resins such as Surlyn AD8265 (Na), Surlyn AD8269 (Na), etc. Examples of the ionomer resin which is commercially available from Exxon Chemical Co. include Iotek 7010 (Zn), 8000 (Na), etc. In addition, Na, Zn, K, Li, Mg, etc., which are described in parenthesis following the trade name of the above ionomer resin, mean the neutralizing metal ion species thereof.

The cover is mainly made from the thermoplastic resin as mentioned above, but may contain a small amount of additives, such as a colorant (e.g. titanium oxide), a UV absorber, a light stabilizer, a fluorescent agent and a fluorescent brightener, as long as the addition of the additives does not deteriorate the desired performance of the golf ball cover.

A method of covering the cover on the solid core is not specifically limited. For example, a method comprising molding a cover composition into a semi-spherical half-shell in advance, covering a core with two half-shells and then subjecting to a pressure molding at 130° to 170° C. for 1 to 15 minutes, or a method comprising injection molding the cover composition directly on the core to cover the core is used. When molding the cover, dimples may be optionally formed on the cover surface. After molding the cover, paint finishing and stamping may be optionally conducted. The cover may be made two or more layers, using different cover materials.

According to the present invention, the cover is required to have a Shore D hardness of 52 to 64. Shore D hardness is measured according to ASTM D-2240. If the cover has a Shore D hardness of less than 52, rebound characteristics are deteriorated and flight distance is poor. If it is more than 64, the controllability of the golf ball deteriorates and shot feel is also hard.

The present invention also requires that the dimples formed on the surface of the cover satisfy the equation of (dimple area proportion (%))×(total dimple volume ($mm^3$))÷100 being 220 to 270. If it is more than 270, the trajectory of the golf ball when hitting is low and the flight distance decreases and if it is less than 220, the trajectory is too high and the flight distance also decreases. The term "dimple area proportion" employed herein means a proportion expressed in percentage of a total of an area of a circle formed by an edge 1 of a dimple 2 divided by the ball surface area calculated from the ball diameter (see FIG. 1 ). The term "total dimple volume" used herein means the total of the volume in $mm^3$ of a hollow (oblique line portion 3 in FIG. 1) formed by a plain 4 in touch with the edge 1 of the dimple 2 and an inner wall of the dimple 2. In this context, the term "total" means the sum of all the dimples.

It is preferred that the dimple area proportion of the solid golf ball of the present invention is within the range of 70 to 88%. If it is less than 70%, the trajectory is too high and the flight distance decreases. If it is more than 88%, the trajectory is too low and the flight distance decreases. The total dimple volume is preferably within the range of 260 to 360 $mm^3$. If it is less than 260 $mm^3$, the trajectory is too high and the flight distance decreases. If it is more than 360 $mm^3$, the trajectory is too low and the flight distance decreases.

The cover of the solid golf ball of the present invention preferably has a thickness of 1.40 to 2.30 min. If it is more than 2.30 mm, rebound characteristics are poor and flight distance is poor. The cover material which forms the cover generally has a flexural modulus of 1,000 to 2,500 $Kgf/cm^2$. If is less than 1,000 $Kgf/cm^2$, the cover is too soft and flight distance decreases. If it is more than 2,500 $Kgf/cm^2$, the core is too hard and controllability is deteriorated.

The size and weight of the solid golf ball of the present invention is adjusted to a suitable range which satisfies golf rules.

EXAMPLES

The following Examples and Comparative Examples further illustrate the present invention in detail but are not to be construed to limit the present invention to their details.

Preparation of Core A

The ingredients shown in Table 1 were sufficiently mixed and vulcanized into a spherical core A having a diameter of 39.0 mm. The vulcanization was conducted as shown in Table 1 in two step and the first step was at 140° C. for 30 minutes and the second step was at 170° C. for 10 minutes. The core A had a deformation amount of 2.75 mm, which was determined by applying from 10 Kg to 130 Kg.

TABLE 1

| Ingredients | Core A | |
|---|---|---|
| BR-01*1 | 100 | |
| Zinc acrylate | 33 | |
| zinc oxide | 20 | |
| Antioxidant*2 | 0.5 | |
| Dicumyl peroxide | 1.1 | |
| Vulcanization condition | 143°C. | ×30minutes |
| | 170°C. | ×10minutes |
| Deformation amount of core A (mm) | 2.75 | |

*1Polybutadiene rubber having a cis-1,4 content of 97%, available from Japan Synthetic Rubber Co., Ltd.
*2Available from Ouchi Shinko Kagaku K.K.

Examples 1 to 3 and Comparative Examples 1 to 4

The ingredients shown in Table 2 was mixed and injection-molded onto the core A obtained above to form a cover layer. Three types of the ingredients for cover were prepared and they were indicated X, Y and Z. Shore D hardness and flexural modulus of each cover were determined and the result are shown in Table 2.

TABLE 2

| | X | Y | Z |
|---|---|---|---|
| Hi-milan 1605*3 | 50 | 10 | 10 |
| Hi-milan 1706*4 | 50 | 10 | 5 |
| Hi-milan 1855*5 | — | 80 | — |
| Hi-milan 8120*6 | — | — | 85 |

TABLE 2-continued

| | X | Y | Z |
|---|---|---|---|
| Shore D hardness | 68 | 57 | 50 |
| Flexural modulus (Kgf/cm$^2$) | 3500 | 1500 | 600 |

*3Ionomer resin neutralized with Na, available from Mitsui DuPont Chemical Co., Ltd.
*4Ionomer resin neutralized with Zn, available from Mitsui DuPont Chemical Co., Ltd.
*5Ionomer resin neutralized with Zn, available from Mitsui DuPont Chemical Co., Ltd.
*6Ethylene-methacrylic acid-methacrylic ester ionomer resin neutralized with sodium, available from Mitsui DuPont Chemical Co., Ltd.

Table 3 shows the types of the cover ingredients and the thickness of the cover for Examples 1–3. Dimples were formed as the cover was injection-molded. Dimple area proportion, total dimple volume and a value of (dimple area proportion (%))×(total dimple volume (mm$^3$))÷100 were measured and calculated and the result are shown in Table 3. Also, the depth, diameter and number of the dimples which actually formed in Examples are shown in Table 4.

The resulting solid golf balls were subjected to the evaluation of ball deformation amount, flight distance when hit by a driver, spin amount when hit by a pitching wedge, controllability of approach shot conducted by professional golfers and shot feel by professional golfers, and the results are shown in Table 3.

Ball deformation amount: A deformation of a golf ball when applying from an initial load of 10 Kg to a final load of 130 Kg.

Flight distance by a driver and spin amount by a pitching wedge: A golf club was attached to a swing robot available from True Temper Co. and golf balls were hit. When a driver (No. 1 wood) was used, its head speed was 45 m/second, and when a pitching wedge was used, its head speed was 31 m/second. In case of the driver, a flight distance was determined from the hit point to the finally stop point. In case of the pitching wedge, its spin amount was determined by photographs which were taken by a high speed camera the golf ball with a mark immediate after hitting.

Controllability at approach and shot feel: 10 professional golfer hit golf balls. Approach was a shot facing to a green from a distance of 10 to 70 yards and show feel was a shot using a driver and a No. 5 iron.

Preparation of Core B

The core B is an example of a two layer core.

The ingredients shown in Table 5 were sufficiently mixed and vulcanized into a spherical inner core having a diameter of 34.2 mm. The vulcanization was conducted as shown in Table 5 at 150° C. for 30 minutes. On the inner core, the cover formulation X of Table 2 was injection-molded to obtain the core B having a diameter of 39.0 mm. The core B had a deformation amount of 2.90 mm, which was determined by applying from 10 Kg to 130 Kg.

TABLE 5

| Ingredients | Core B |
|---|---|
| BR-01*1 | 100 |
| Zinc acrylate | 33 |
| zinc oxide | 20 |
| Antioxidant*2 | 0.5 |
| Dicumyl peroxide | 1.1 |
| Vulcanization condition | 150° C. × 30 minutes |
| Deformation amount of core B (mm) | 2.90 |

Example 4

The cover formulation Y of Table 2 was injection-molded on the core B obtained above to form a solid golf ball having dimples on the surface. The dimple are proportion, total dimple volume and a value of (dimple area proportion (%))×(total dimple volume (mm$^3$))÷100 were measured and calculated and the result are shown in Table 3. Also, the depth, diameter and number of the dimples which actually formed in Examples are shown in Table 4.

The resulting solid golf balls were subjected to the evaluation of ball deformation amount, flight distance when hit by a driver, spin amount when hit by a pitching wedge, controllability of approach shot conducted by professional golfers and shot feel by professional golfers, and the results are shown in Table 3.

TABLE 3

| | Examples | | | | Comparative Examples | | | |
|---|---|---|---|---|---|---|---|---|
| | 1 | 2 | 3 | 4 | 1 | 2 | 3 | 4 |
| Core A or B | A | A | A | B | A | A | A | A |
| Cover formulation | Y | Y | Y | Y | X | Y | Y | Z |
| Cover thickness (mm) | 1.85 | 1.85 | 1.85 | 1.85 | 1.85 | 1.85 | 1.85 | 1.85 |
| Deformation amount of ball | 2.60 | 2.70 | 2.75 | 2.80 | 2.50 | 2.60 | 2.50 | 2.80 |
| S) Dimple area proportion (%) | 72 | 76 | 84 | 76 | 72 | 86 | 55 | 72 |
| V) Total dimple volume (mm$^3$) | 320 | 330 | 295 | 330 | 320 | 330 | 320 | 320 |
| S × V ÷ 100 | 230.4 | 250.8 | 247.8 | 250.8 | 230.4 | 283.8 | 176.0 | 230.4 |
| Flight distance by a driver (yards) | 255 | 257 | 253 | 256 | 255 | 240 | 241 | 238 |
| Spin amount by a pitching wedge (rpm) | 9200 | 9300 | 9200 | 9200 | 7800 | 9200 | 9200 | 9300 |

TABLE 3-continued

| | Examples | | | | Comparative Examples | | | |
|---|---|---|---|---|---|---|---|---|
| | 1 | 2 | 3 | 4 | 1 | 2 | 3 | 4 |
| Controllability at approach | Excellent | Excellent | Excellent | Good | Poor | Good | Good | Excellent |
| Shot feel | Good | Good | Good | Good | Hard | Good | Good | Soft |

TABLE 4

| | Dimples | | |
|---|---|---|---|
| Examples | Depth (mm) | Diameter (mm) | Numbers |
| Example 1 | 0.14 | 4.05 | 186 |
| | 0.14 | 3.80 | 114 |
| | 0.14 | 3.35 | 60 |
| | | | Total 360 |
| Example 2 | 0.14 | 4.05 | 132 |
| | 0.14 | 3.50 | 180 |
| | 0.14 | 3.35 | 60 |
| | 0.14 | 3.20 | 60 |
| | | | Total 432 |
| Example 3 | 0.13 | 4.55 | 30 |
| | 0.13 | 4.15 | 102 |
| | 0.11 | 4.15 | 102 |
| | 0.11 | 3.85 | 78 |
| | 0.13 | 3.50 | 60 |
| | 0.13 | 2.90 | 36 |
| | | | Total 408 |
| Example 4 | 0.14 | 4.05 | 132 |
| | 0.14 | 3.50 | 180 |
| | 0.14 | 3.35 | 60 |
| | 0.14 | 3.20 | 60 |
| | | | Total 432 |
| Comparative Example 1 | 0.14 | 4.05 | 186 |
| | 0.14 | 3.80 | 114 |
| | 0.14 | 3.35 | 60 |
| | | | Total 360 |
| Comparative Example 2 | 0.12 | 4.40 | 30 |
| | 0.12 | 4.10 | 130 |
| | 0.13 | 3.75 | 180 |
| | 0.13 | 3.45 | 60 |
| | 0.12 | 2.75 | 32 |
| | | | Total 432 |
| Comparative Example 3 | 0.19 | 4.00 | 132 |
| | 0.19 | 3.80 | 60 |
| | 0.19 | 3.40 | 60 |
| | 0.19 | 3.05 | 60 |
| | | | Total 312 |
| Comparative Example 4 | 0.14 | 4.05 | 186 |
| | 0.14 | 3.80 | 114 |
| | 0.14 | 3.35 | 60 |
| | | | Total 360 |

As is apparent from the above results, Comparative Example 1 shows a golf ball of which cover has a Shore D hardness of 68 which is outside the claimed range of the present invention. The golf ball of this Example shows poor controllability and hard shot feel.

Comparative Examples 2 and 3 show golf balls of which dimples do not satisfy the claimed range of (dimple area proportion (%))×(total dimple volume ($mm^3$))÷100. Both balls showed poor flight distance.

Comparative Example 4 shows a golf ball of which cover has a Shore D hardness of 50 which is also outside the claimed range. The golf ball showed too soft shot feel and poor flight distance.

What is claimed is:

1. A solid golf ball comprising a solid core, a cover covering said core and dimples formed on the surface of the cover, wherein said cover has a Shore D hardness of 52 to 64 and said dimples satisfy the following equation:

$$(\text{Dimple area proportion } (\%))\times(\text{Total dimple volume } (mm^3))\div 100 = 220 \text{ to } 270,$$

wherein the dimple area proportion is within the range of 70 to 88% and the total dimple volume is within the range of 260 to 360 $mm^3$.

2. The solid golf ball according to claim 1, wherein the cover has a thickness of 1.40 to 2.30 mm and a flexural modulus of 1,000 to 2,500 $Kgf/cm^2$.

3. The solid golf ball according to claim 1, wherein the core has a deformation amount of from 10 Kg to 130 Kg being within the range of 2.50 to 3.50 mm.

4. The solid golf ball according to claim 1, wherein the cover has a flexural modulus of 1,000 to 2,500 $Kgf/cm^2$.

* * * * *